US005116220A

United States Patent [19]

Kinzel et al.

[11] Patent Number: 5,116,220

[45] Date of Patent: May 26, 1992

[54] QUICK DISCONNECT CLIP FOR GAS LATERN MANTLE

[76] Inventors: George M. Kinzel, 521 Case, St. Paul, Minn. 55101; James L. Warren, 2314 Dorothy Ave., White Bear Lake, Minn. 55110

[21] Appl. No.: 692,964

[22] Filed: Apr. 26, 1991

Related U.S. Application Data

[63] Continuation of Ser. No. 489,241, Mar. 5, 1990, abandoned.

[51] Int. Cl.[5] ..... F21H 1/04

[52] U.S. Cl. ..... 431/113; 431/111; 431/100

[58] Field of Search ..... 431/100, 101, 102, 109, 431/111, 112, 113; 24/27; 215/272, 275; 362/179

[56] References Cited

U.S. PATENT DOCUMENTS

| | | | |
|---|---|---|---|
| 919,645 | 2/1909 | Rybar | 431/109 |
| 935,241 | 9/1909 | Weyer | 431/109 |
| 968,696 | 8/1910 | Schleichen | 215/275 |
| 982,958 | 1/1911 | Handinig | 431/100 |
| 4,280,722 | 7/1981 | Guptil et al. | 24/27 X |
| 4,599,683 | 7/1986 | Bechham et al. | 431/311 |
| 4,881,893 | 11/1989 | Mellini | 431/100 |

FOREIGN PATENT DOCUMENTS

| | | | |
|---|---|---|---|
| 2030901 | 12/1971 | Fed. Rep. of Germany | 431/100 |
| 2206643 | 8/1973 | Fed. Rep. of Germany | 431/110 |
| 70027 | 2/1946 | Norway | 215/275 |
| 406879 | 8/1966 | Switzerland | 215/275 |

*Primary Examiner*—Carl D. Price

*Attorney, Agent, or Firm*—Jacobson and Johnson

[57] ABSTRACT

A resilient wire clip goes around the mouth of a gas latern mantle to hold the mantle securely in place around the opening of the tube and can be manually expanded to release the mantle when it has to be replaced.

2 Claims, 1 Drawing Sheet

QUICK DISCONNECT CLIP FOR GAS LATERN MANTLE

This application is a continuation of application Ser. No. 07/489241, filed Mar. 5, 1990, now abandoned.

FIELD OF THE INVENTION

This invention is directed toward outdoor gas lanterns and more specifically toward means for releasably attaching a gas lantern mantle to the burner tube.

DESCRIPTION OF THE PRIOR ART

Dating back at least to 1909, as exemplified by U.S. Pat. No. 919,645 by Rybar, gas lanterns or lamps utilize a bag-like gas permeable mantle over the opening at one end of a gas tube and the lantern is turned on by allowing the gas mixture to flow into the burner tube and igniting the gas in the mantle which then provides the glow or light. Typically and conventionally, the mantle is a relatively open mesh bag made of suitably treated interwoven fibers or threads and has an opening or mouth which fits over and totally encloses the burner tube opening. Also typically and conventionally, the mantle may be reused a number of times but eventually deteriorates and has to be replaced. The aforementioned Rybar patent shows a ring and collar combination for removably attaching the mantle to the burner tube. This requires a collar permanently attached to the burner tube around or closely adjacent the gas outlet opening and a ring, suitably attached around the mouth of the mantle, with hooks to engage the collar. As explained in the Rybar patent, to remove the mantle the ring is lifted upwardly until the hooks are elevated above lugs on the collar and then the ring is turned until the hooks are free from engagement with the collar. The Rybar arrangement therefore requires that the ring be an integral part of the mantle and that the burner tube be modified to make the collar an integral part of the burner tube. It also requires some dexterity on the part of the user to remove and replace the mantle.

Typically and conventionally, in general the contemporary manner of attaching the mantle to the burner tube is by use of a drawstring interwoven in the mantle at or near the mouth or opening of the mantle. After the user slips the mantle opening over the open end of the burner tube, the two ends of the drawstring are pulled tight and knotted together. Any extending ends are then snipped off. This makes it quite cumbersome for a camper or outdoorsman to replace the mantle. Not only is it awkward because of the confined area that the camper's fingers have to work in, but if the weather is cold, the fingers do not have the necessary dexterity. The use of the drawstring for attaching the mantle appears to be illustrated, but not described, in U.S. Pat. Nos. 4,599,683 by Beckham, et al.

SUMMARY OF THE INVENTION

For a conventional gas lantern which has a burner tube and a mantle enclosing the gas outlet end of the burner tube, a resilient clip made of resilient wire is provided having a circular or bight portion for surrounding the mouth or opening of the mantle for holding it securely in place around the open end of the burner tube and ends which can be pushed or squeezed together to expand the bight portion to release the mantle from the burner tube. In one embodiment the clip encircles the outside of the mantle opening to hold it releasably secured to the burner tube. In another embodiment the bight portion of the clip is threaded through the mantle at or near the opening or mouth of the mantle to encircle the mouth. Preferably the clip ends have short angled arms which can be easily grasped between the fingers of the user and squeezed together to expand the bight portion of the clip to slip the clip over the end of the tube for attaching and removing the mantle. Neither embodiment requires any modification of the lantern burner tube. For the embodiment in which the mantle is threaded onto the clip, it is quite easy to thread the clip in and around the mouth of the mantle. This may be done at the time the mantle is made so that the user doesn't have to do it. The instant invention thereby avoids and eliminates the cumbersome act of having to tighten and knot a drawstring and clipping off the ends of the drawstring.

DESCRIPTION OF THE PREFERRED EMBODIMENT

Figure 1:
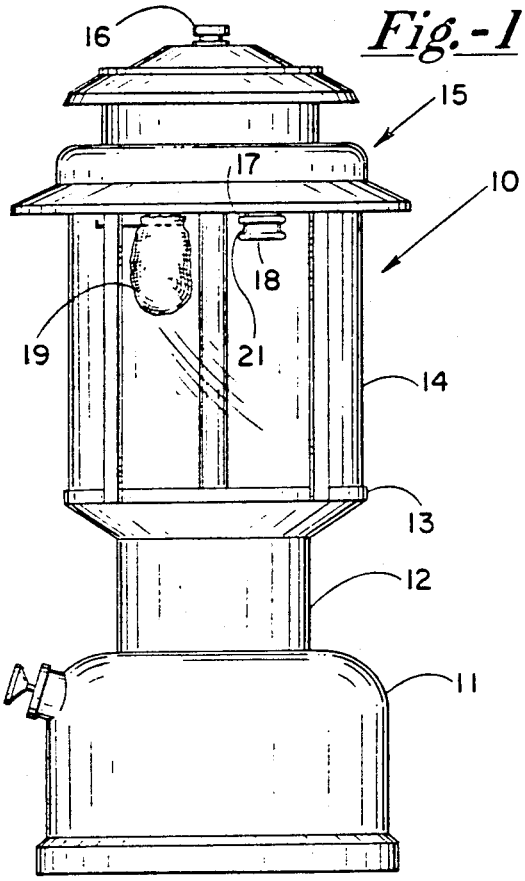
FIG. 1 is an elevational view of a typical and conventional gas lantern or lamp with which the instant invention is used.

Typically and conventionally a portable gas lantern 10 suitable for and often used outdoors for camping has a fuel tank 11 as its base supporting a vertical collar 12 and a supporting plate 13 at the top of collar 12 on which rests a cylindrical transparent globe 14, a top, generally designated by reference number 15, over the top end of globe 14 which is held in place by an integrally threaded knurled or wing nut screwed onto a threaded stud, not shown. In the interior of globe 14 extending downward from and in gas communication with a gas manifold, now shown, are a pair of burner tubes 17 which are open at their bottom ends 18. Surrounding and enclosing each of the open ends 18 of burner tubes 17 are mantles 19 (only one shown for clarity). Mantles 19 are conventional and are commercially available. Mantle 19 is an air or gas porous or permeable bag made out of suitably treated interwoven threads or fibers and having a mouth or opening 20 which is placed over the open end 18 of burner tube 17. Near its open end 18 burner tube 17 has an outer annular recess 21. Mouth 20 of mantle 19 is placed over the open end 18 of burner tube 17 to extend partly over the annular recess 21. In the past, conventionally, a drawstring which was threaded into the mantle around the mantle mouth would then be pulled tightly and snugged down in the annular recess 21 and then the ends tied or knotted together to hold the mantle in place on the burner tube. As mentioned earlier, any extending ends of the drawstring would then be snipped off. Instead of a drawstring, the present invention provides a clip, generally identified by reference numeral 25, which is made of some suitable resilient metal wire and shaped to have a circular or bight section 25A and a pair of distal ends 25B and C. Clip 25 is formed so that the diameter of the circular or bight section 25A, when at rest, is somewhat smaller than the outer diameter of the annular recess 21. Ends 25B and C can be squeezed together to enlarge the opening of the bight section 25A so that it is greater than the outer diameter of burner tube 17.

Figure 2:
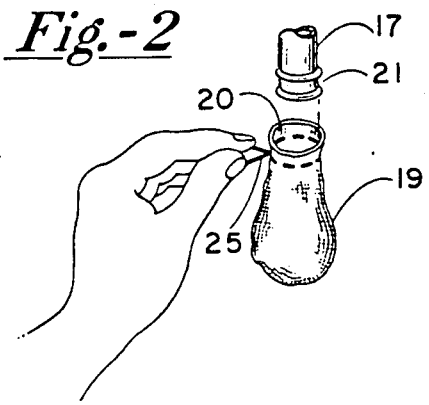
FIG. 2 is a closeup view illustrating the manner in which the instant invention is utilized in a conventional gas lantern.
Figure 3:
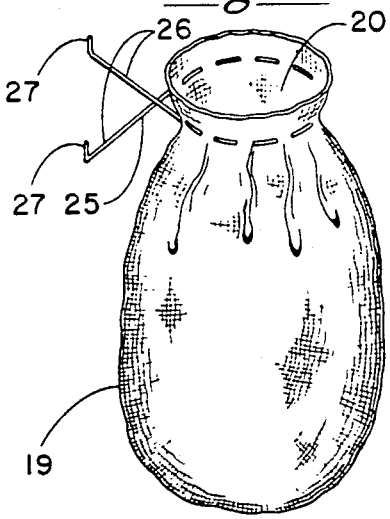
FIG. 3 is a somewhat perspective view illustrating an embodiment of the invention with the clip threaded onto the mantle.
Figure 5:
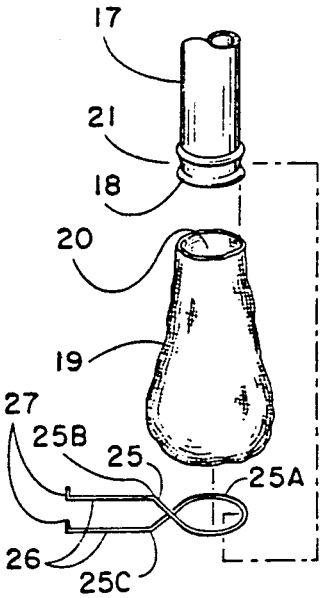
FIG. 5 illustrates another embodiment in which the clip is placed around the outside of the mouth of the mantle.
Figure 4:
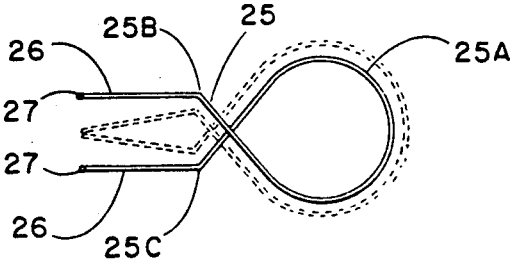
FIG. 4 is a view illustrating how the clip is moved to expand the bight or circular opening.

In use, using the embodiment illustrated in FIG. 5, the mouth or opening 20 of mantle 19 is slipped through the opening of bight 25A and over the outside of the open end 18 of burner tube 17 until it is slightly past recess 21. The ends 25B and C of clip 25 are squeezed together by the fingers, as illustrated in FIG. 2, so that the bight portion 25A is expanded to slip over the outside of the mantle and then released to come to rest in the annular recess 21 to hold the mantle snugly onto the burner tube 17. Alternatively, as illustrated in FIG. 3, mantle 19 can be threaded onto the bight portion 25A generally surrounding mouth 20 and the mantle with the attached clip can then be attached to burner tube 17 by squeezing together the ends of clip 25 until the bight and mantle mouth openings enlarge enough to slip over the ends 18 of burner tube 17 and the ends are then released to allow the clip to rest in the recess 21. To release the mantle for replacement, the ends 25B and C are again squeezed together until the bight portion 25A expands or enlarges beyond the outside of burner tube 17 and the mantle and clip are then slipped off the burner tube. Preferably, attached to and extending outward from ends 25B and C are arm members 26 which provide some extra leverage and make it more convenient to squeeze the ends together. Also, upstanding fingers 27 may be provided at the distal ends of arms 26 as a further convenience.

Some experimentation has shown that, at worse, the metal clip only gets warm to the touch even after the lamp has been lit for some time. However, preferably, clip 25 should be made of a material which has the desired resiliency and also be able to withstand any significant deterioration at elevated temperature. Naturally, since a lantern of this nature might be used in very cold climates, the clip material should not lose any significant resiliency at the low temperatures which might be encountered.

We claim:

1. A replacement mantle for a gas lantern having a burner tube with an outlet opening at one end for gas to exit for ignition, in combination:

a bag-shaped mantle made of mesh fabric, the mantle having a mouth opening for surrounding the burner tube at the tube gas outlet end; and a unitary resilient wire clip having a bight section and two ends, said bight section engaging the mantle mouth by being threaded around the mantle mouth opening, said bight section biased to make the mantle mouth opening smaller than the burner tube, said wire ends being manually squeezable together for expanding the bight section to make the mantle mouth opening larger than the burner tube.

2. A replacement mantle for a gas lantern having a burner tube with a gas outlet opening at one end for gas to exit for ignition, comprising in combination:

a bag-shaped replaceable mantle made of mesh fabric, the mantle having a mouth opening for surrounding the burner tube at the gas outlet opening end; and a unitary resilient wire having a bight section and two ends, said bight section threaded around the mantle mouth for holding said mantle mouth around the burner tube at the gas outlet end of said burner tube when the wire ends are at rest, and for expanding the mantle mouth away from the burner tube when the wire ends are manually squeezed together.

* * * * *